US009909593B2

(12) United States Patent
Dieziger

(10) Patent No.: US 9,909,593 B2
(45) Date of Patent: Mar. 6, 2018

(54) CENTRIFUGAL PUMP FOR DE-WATERING

(71) Applicant: David Douglas Dieziger, Missoula, MT (US)

(72) Inventor: David Douglas Dieziger, Missoula, MT (US)

(73) Assignee: Helen Irene Dieziger, Post Falls, ID (US)

( * ) Notice: Subject to any disclaimer, the term of this patent is extended or adjusted under 35 U.S.C. 154(b) by 1032 days.

(21) Appl. No.: 13/632,282

(22) Filed: Oct. 1, 2012

(65) Prior Publication Data

US 2013/0022447 A1 Jan. 24, 2013

Related U.S. Application Data

(63) Continuation-in-part of application No. 12/497,190, filed on Jul. 2, 2009, now abandoned.

(51) Int. Cl.

| | |
|---|---|
| ***F04D 29/12*** | (2006.01) |
| ***F04B 17/05*** | (2006.01) |
| ***F04D 13/02*** | (2006.01) |
| ***F04D 13/04*** | (2006.01) |
| ***F04D 9/00*** | (2006.01) |
| ***F04D 29/10*** | (2006.01) |

(52) U.S. Cl.

CPC ..... *F04D 29/126* (2013.01); *F04B 17/05* (2013.01); *F04D 9/001* (2013.01); *F04D 13/02* (2013.01); *F04D 13/04* (2013.01); *F04D 29/106* (2013.01)

(58) Field of Classification Search

CPC ..... F04D 13/02; F04D 29/061; F04D 29/086; F04D 29/10; F04D 29/126; F04D 29/128; F04D 29/106; F04D 9/02; F04B 17/05

See application file for complete search history.

(56) References Cited

U.S. PATENT DOCUMENTS

| | | | | |
|---|---|---|---|---|
| 656,465 | A | 8/1900 | Marburg | |
| 4,134,711 | A * | 1/1979 | Ivins et al. | 417/370 |
| 4,256,436 | A | 3/1981 | Fandrey | |
| 4,488,852 | A | 12/1984 | Ivins | |
| 5,100,288 | A | 3/1992 | Stanislao | |
| 5,509,779 | A * | 4/1996 | Mori et al. | 415/56.1 |
| 5,599,164 | A | 2/1997 | Murray | |
| 5,868,550 | A | 2/1999 | Howchin | |
| 7,094,016 | B1 | 8/2006 | Zaher | |
| 7,537,439 | B2 * | 5/2009 | Pohler | F04B 23/08 310/62 |
| 2008/0089777 | A1 | 4/2008 | Lang | |

* cited by examiner

*Primary Examiner* — Justin Seabe
*Assistant Examiner* — Juan G Flores
(74) *Attorney, Agent, or Firm* — Kunzler, PC

(57) ABSTRACT

A method of de-watering during intermittent dry running periods with a self-priming centrifugal pump is presented. Centrifugal pumps, as opposed to diaphragm pumps, are advantageous because they are less expensive and can provide greater capacity. The shaft seals are sensitive, however, to frictional heating when water flow is interrupted. In some situations, this fractional heating may desiccate self-priming. The inventive concept provides a continuous stream of pressurized water moving through the pump to cool the seal and sustain priming capability without substantially impairing the ability of the pump to resume wet operation.

11 Claims, 4 Drawing Sheets

CENTRIFUGAL PUMP FOR DE-WATERING

CROSS-REFERENCE TO RELATED APPLICATIONS

This is a Continuation-In-Part application claiming priority to U.S. patent application Ser. No. 12/497,190, filed on Jul. 2, 2009.

FIELD OF THE INVENTION

This invention relates to centrifugal pumps, and more particularly the use of self-priming centrifugal pumps for de-watering scenarios.

BACKGROUND OF THE INVENTION

Centrifugal pumps have high capacity, measured in gallons per hour (gph), are readily available, and are generally inexpensive. They are, however, unsuitable for de-watering because de-watering requires intermittent to extended periods of dry operation. An example of a de-watering scenario is the draining of a thin mud slurry sloughed onto a recovery mat while washing trucks, or other vehicles.

Reciprocating diaphragm pumps can be operated dry and are suitable for dewatering. They have low capacity, however, and can be quite expensive. Compared to the least expensive diaphragm pump, a centrifugal pump could cost 70%-80% less while having twice the head and nearly four times the capacity for throughput.

The impeller of a centrifugal pump has a shaft which extends through a housing to an external motor. The housing, which is a chamber containing the volute, is rendered water-tight by means of a seal surrounding the shaft, or the bearing in which the shaft is situated. The seal can be degraded by the heat of friction, which is normally dissipated by the circulation of fluid through the chamber. The seal can be quickly destroyed, however, during a period of dry running, such as may occur when water is draining from a slurry into a pool which is periodically pumped dry.

U.S. Pat. No. 5,667,357 to Buse et al discloses a system for providing a flow of water to the bearing seal during intermittent periods of dry running. The water is recycled from a reservoir connected to the output port of the pump. The reservoir is effectively a bulge in an ascending pipe which retains a body of water therein. The pressure gradient, or head, caused by the rotating impeller, drives a recirculation current from the body of water through a pre-existing channel system, designed to externally irrigate the bearing casing, back to the volute chamber.

U.S. Pat. No. 4,773,823 to Pease teaches a similar system, except that the object in this case is to increase the life of the seal rather than to sustain dry running periods. The recirculated water is drawn not from a reservoir, but directly from the volute. Since there is always a torus of water in the volute, even during dry running, conceptually there is a supply, at least for short periods, for continuous recirculation.

In both Buse and Pease, the cooling effect is achieved by water which has been previously heated and recycled. The system, therefore, is thermally inefficient and, in some sense, self-defeating. In addition, the porting through the bearing housing for channeling the recirculation would weaken the very structure which is under dynamic stress. What is needed is a simple method of providing a continuous flow of fresh water through the pump when the suction is otherwise dry-cycling.

SUMMARY OF THE INVENTION

It is accordingly an object of the invention to provide a method for cooling the shaft seal of a self-priming centrifugal pump during intermittent dry running.

It is a second object to provide a simple method, which can be easily implemented on any existing self-priming pump.

It is a third object to provide a flush of fresh water under pressure through the pump at all times during running, whether running wet or dry.

It is a fourth object to provide a sufficient flow of water to ensure that the pump does not lose its capability to re-prime.

These and other objects of the invention to become apparent hereinafter in accordance with the invention in a method of dewatering an intermittently dry pool, comprising the steps of providing a self-priming centrifugal pump having inlet and discharge ports and an impeller; connecting the impeller to an engine through a shaft fitted with a seal providing water-tight isolation, the impeller creating a head manifest as suction in the inlet port; establishing fluid communication between the inlet port and the pool; and introducing a means for continuously cooling the shaft seal without occluding the suction, whereby degradation of the seal by heat of friction is avoided.

In a preferred embodiment of the method of dewatering, the means for continuously cooling is provided by a pressurized source of liquid introduced to the inlet port at a fraction of the pump capacity, the liquid streaming continuously regardless of dry or wet operation. In a particular preferred embodiment, the liquid is water under line pressure.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
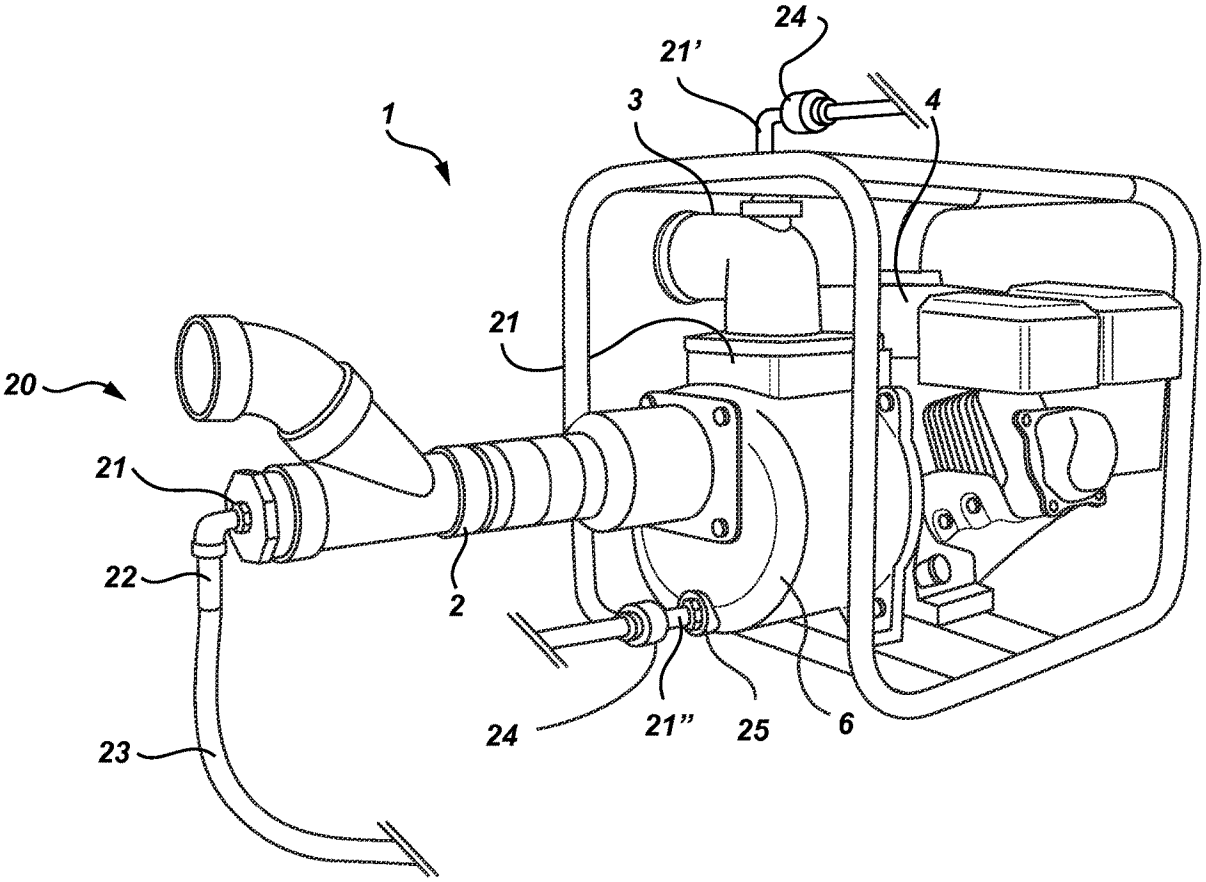
FIG. 1 is a perspective view of the invention, illustrating a centrifugal pump connected to a source of streaming water.
Figure 2:
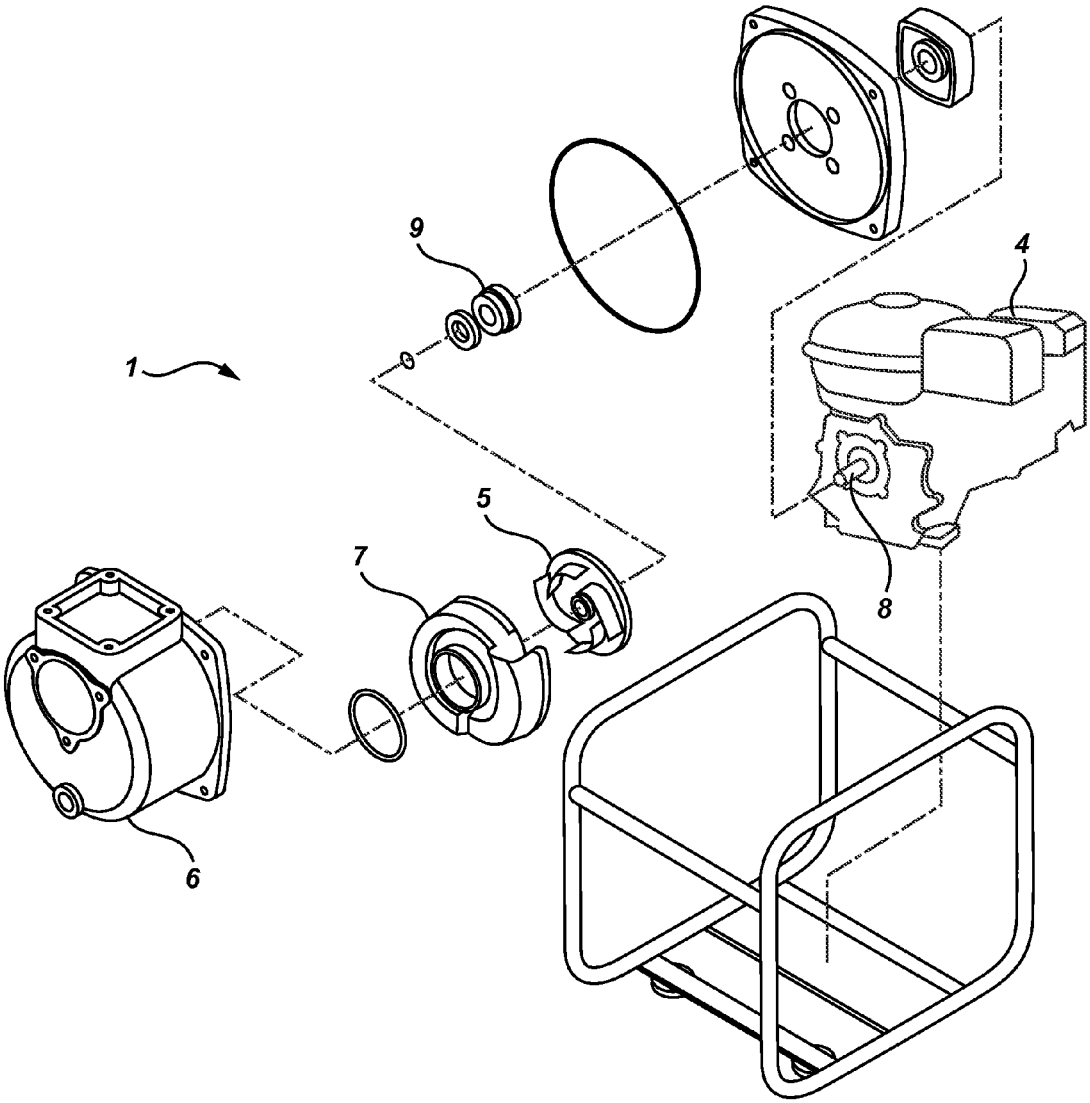
FIG. 2 is a partial exploded view of the centrifugal pump of FIG. 1 in perspective.

FIGS. 1 and 2 show the major components of the invention. Self-priming centrifugal pump 1 is comprised of engine 4 connected to housing 6. Housing 6 contains impeller 5 which receives rotary power from engine 4 through shaft 8. Shaft 8 is maintained water-tight by seal 9. Impeller 5 receives liquid material at its center through inlet port 2 and expels it outwardly, centrifugally, creating thereby pressure, or head. The expelled material is thrown into a circular path in volute 7 and exits there from through discharge port 3.

In the preferred embodiment, a means for continuously cooling the seal 20 is facilitated by coolant port 21 in inlet port 2. In a particularly preferred embodiment, said means is a pressurized source of liquid 22. The pressurized source of liquid 22 may be water under line pressure supplied by hose 23. Coolant port 21 and hose 23 are connected in a manner that is sealed and prevents the suction from being vented. Coupler 21 and hose 23 may alternatively be connected at the discharge end of the pump, as shown in phantom line in FIG. 1.

The pressure in the pressurized source of liquid 22 must be such that only a fraction of the pump capacity is utilized in processing the flow of liquid there through during a dry cycle. In other words, it is required that suction remains available in inlet port 2 to resume pumping when the cycle returns to wet. In a particularly preferred embodiment, the fraction of pump capacity is defined by the pressure source delivering 3-10 gpm to a centrifugal pump operating at 100-150 gpm.

Figure 3:
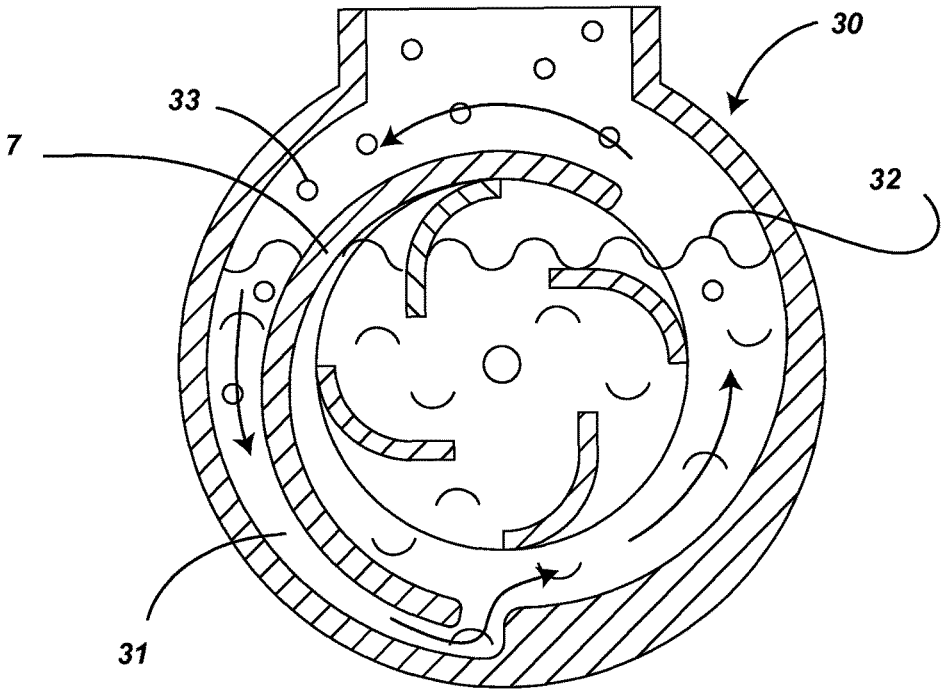
FIG. 3 is a diagram showing the internal chamber of a self-priming pump during recycling mode.
Figure 4:
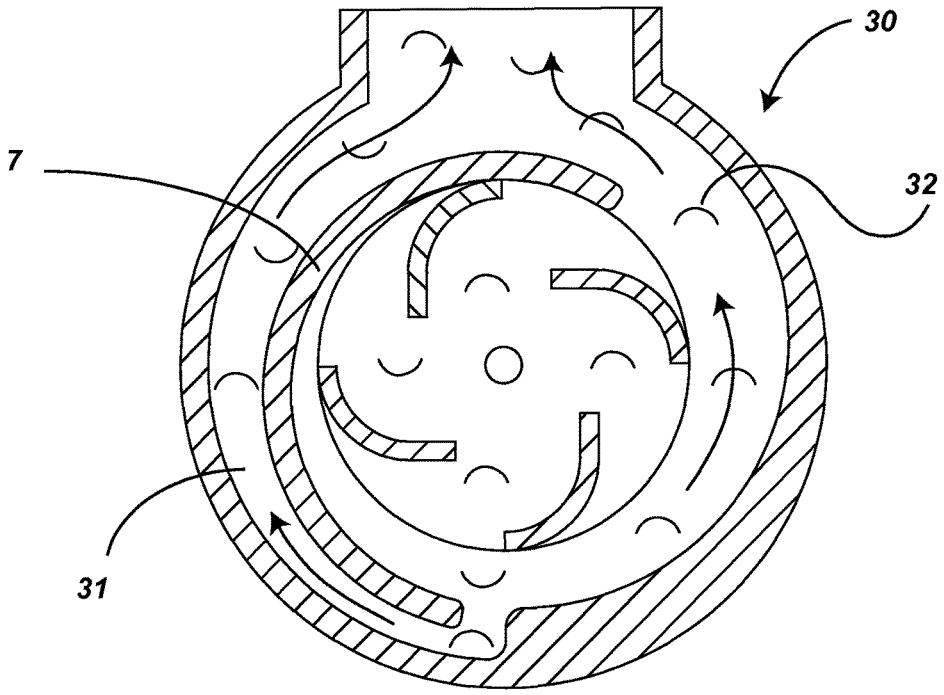
FIG. 4 is a diagram showing the internal chamber of a self-priming pump during suction mode.
Figure 5:
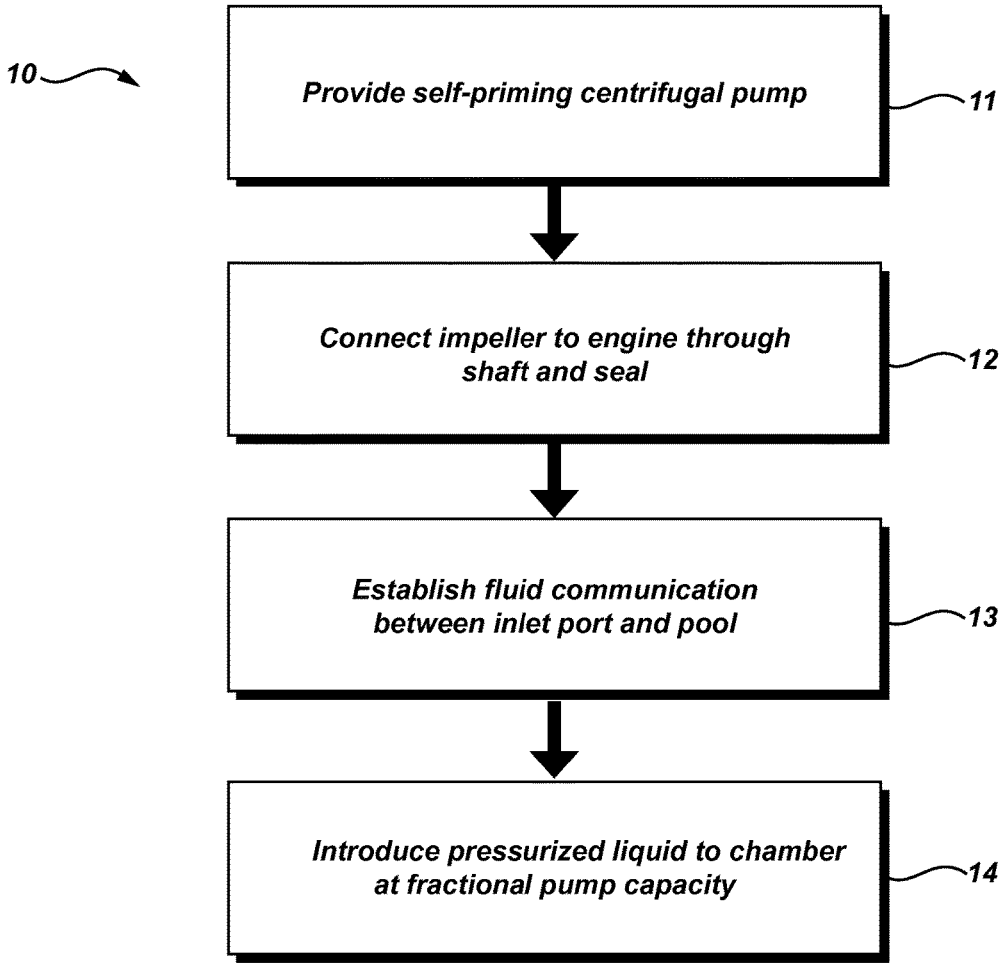
FIG. 5 is a process diagram following the steps of the invention.

As shown in FIG. 3, a self-priming pump 30 has an internal chamber 31 which maintains a reservoir of water 32. A non-self-priming pump will become air-bound when air 33 enters the suction line, as may occur when the pumpage pool is intermittently drained. With the reservoir of water 32, however, the pump can create an internal circulation to remove the air 33 by settlement of water as the heavier fluid. The air-water mixture has sufficient consistency to create a vacuum at the inlet port 2; and, thereby, the pump will re-prime itself when the pumpage pool returns. During dry cycling, however, the reservoir of water 32 may become heated sufficiently to degrade the seal 9. The means for cooling the seal 20 introduces a stream of fresh water to prevent such over-heating.

In alternative embodiments, a coolant port 21' may be located at the discharge side of the pump, or a coolant port 21" may be located at the drain port 25, as shown in FIG. 1. The coolant ports 21' and 21" supply pressurized liquid 22 directly into the internal chamber 31. The internal chamber 31 operates at a higher pressure during suction operation. When the pressure in the internal chamber 31 exceeds that of the pressurized source of liquid 22, a backpressure regulator 24 located in the supply line will prevent unwanted back flow. During dry operation, however, the pressure balance favors a continuous flow of the pressurized liquid 22 into the chamber to cool the recycling reservoir of water 32 and to prevent thereby the degradation of seal 9. The continuous flow also replenishes evaporative losses caused by friction heating during dry cycling and acts, accordingly, to prevent loss of prime.

Construction materials are readily available. Centrifugal pumps, such as that shown in FIG. 1 can be found at pump supply distributors. In the specific case of FIG. 1, the self-priming centrifugal pump 1 is a NorthStar™ 2-inch semi-trash pump. Inlet port 2 and coupler 21 can be easily fabricated with 2-inch PVC pumping materials. The one-quarter inch hose 23 is a ubiquitous hardware item. Water for the pressurized source of liquid 22 can be supplied from any utility having line pressure, such as well or tap water A method of de-watering an intermittently dry pool 10 is shown in the process diagram of FIG. 3. The method comprises the steps of providing a self-priming centrifugal pump 11, connecting the impeller to an engine through a shaft and seal 12, establishing fluid communication between the inlet port and pool 13, and introducing a pressurized liquid to the input at fractional pump capacity 14.

While a particular form of the invention has been illustrated and described, it will be apparent that various modifications can be made without departing from the spirit and scope of the invention. For example, the invention could be practiced with the pump located at an elevation below that of a body of water, such as a pond, by means of siphoning. Accordingly, it is not intended that the invention be limited, except as by the appended claims.

What is claimed is:

1. A method comprising:

providing a self-priming centrifugal pump comprising:
- an inlet port;
- an impeller within a volute;
- an internal chamber in fluid communication with the volute to deliver water from an air-water mixture expelled by the impeller back to the volute during a recycling mode; and
- a discharge port to discharge air from the air-water mixture out of the self-priming centrifugal pump during the recycling mode; and injecting water into the self-priming centrifugal pump to maintain a reservoir of water within the volute sufficient to cool a shaft seal of the self-priming centrifugal pump and generate the air-water mixture at the impeller to provide suction at the inlet port, wherein injecting the water into the self-priming centrifugal pump comprises injecting the water into the self-priming pump through the discharge port at a fraction of a pumping capacity of the self-priming centrifugal pump.

2. The method of claim 1, wherein the water is under line pressure.

3. The method of claim 1, wherein injecting the water at the fraction of the pumping capacity comprises injecting the water at a rate of approximately 3-5 gallons per minute to the self-priming centrifugal pump which is capable of operating at a rate of approximately 100-150 gallons per minute in a suction mode.

4. A method comprising:

providing a self-priming centrifugal pump comprising:
- an inlet port;
- an impeller within a volute;
- an internal chamber in liquid communication with the volute to deliver liquid from a gas-liquid mixture expelled by the impeller back to the impeller within the volute during a recycling mode; and
- a discharge port to discharge gas from the gas-liquid mixture out of the self-priming centrifugal pump during the recycling mode; and providing a coupling in fluid communication with the volute, the coupling sized sufficient to accommodate delivery of a pressurized liquid from a pressurized liquid source to the volute in a quantity sufficient to support generation of the gas-liquid mixture to provide suction at the inlet port, wherein the coupling is in fluid communication with the volute through one of:
- the discharge port of the self-priming centrifugal pump;
- the inlet port of the self-priming centrifugal pump; and
- a drain port of the self-priming centrifugal pump.

5. The method of claim 4, wherein the pressurized liquid is water under line pressure.

6. The method of claim 4, wherein the quantity sufficient to support generation of the gas-liquid mixture to provide suction at the inlet port is less than a pumping capacity of the self-priming centrifugal pump.

7. A system comprising:

a self-priming centrifugal pump comprising:
- an impeller;

a volute at least partially surrounding the impeller, wherein the volute is sized to be partially filled with a liquid and partially filled with a gas during a recycle mode, the liquid and gas forming a mixture in response to rotation of the impeller during the recycle mode; and an internal chamber disposed on a side of the volute opposite the impeller, the internal chamber having a geometry to direct liquid separated from the mixture toward the impeller during the recycle mode; and a coupler attached to the self-priming centrifugal pump, the coupler forming a liquid path to provide a pressurized liquid from a pressurized liquid source to the volute in a quantity sufficient to support generation of suction at an inlet port, wherein liquid from the inlet port flows to the volute during a suction mode, wherein the coupler is attached to the self-priming centrifugal pump one of:

upstream of an inlet port of the self-priming centrifugal pump;

at approximately a discharge port of the self-priming centrifugal pump, and in direct fluid communication with a discharge pathway of fluid from the self-priming centrifugal pump; and at approximately a drain port of the self-priming centrifugal pump.

8. The system of claim 7, wherein the geometry of the internal chamber is further to direct liquid away from the impeller during the suction mode.

9. The system of claim 7, wherein the coupler further comprises a backpressure regulator to substantially prevent flow through the coupler away from the self-priming centrifugal pump.

10. The system of claim 7, wherein the quantity to support the generation of suction at an inlet port is less than a pumping capacity of the self-priming centrifugal pump.

11. The system of claim 7, wherein the pressurized liquid is delivered to the self-priming centrifugal pump at approximately 3-10 gallons per minute and the self-priming centrifugal pump pumps at approximately 100-150 gallons per minute in the suction mode.

* * * * *